US006460600B1

(12) United States Patent
Wuepper et al.

(10) Patent No.: US 6,460,600 B1
(45) Date of Patent: Oct. 8, 2002

(54) APPARATUS AND METHOD FOR PRODUCING CAST PRODUCTS

(75) Inventors: Thomas E. Wuepper, Alger, MI (US); James E. Bohs, Upper Sandusky, OH (US); Ronald L. Klinger, Boon, MI (US); Thomas J. H. Rozich, Au Gres, MI (US); Mark T. Salgat, Pinconning, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 0 days.

(21) Appl. No.: 09/836,531

(22) Filed: Apr. 17, 2001

(51) Int. Cl.[7] ..... B22D 5/04
(52) U.S. Cl. ..... 164/130; 164/323; 164/324
(58) Field of Search ..... 164/129, 130, 164/322–331

(56) References Cited

U.S. PATENT DOCUMENTS

| | | | | |
|---|---|---|---|---|
| 3,982,890 A | 9/1976 | Lovell | 432/138 |
| 5,307,608 A | 5/1994 | Muir et al. | 53/440 |
| 5,518,105 A | 5/1996 | Richard et al. | 198/459.1 |
| 5,664,322 A | 9/1997 | Best | 29/784 |
| 5,682,758 A | 11/1997 | Jones | 62/374 |
| 5,901,774 A | 5/1999 | Hunter et al. | 164/324 |
| 5,904,203 A | 5/1999 | Mai | 164/353 |
| 6,145,577 A | 11/2000 | Hunter et al. | 164/323 |
| 6,216,767 B1 | 4/2001 | McMellon | 164/324 |

FOREIGN PATENT DOCUMENTS

| | | |
|---|---|---|
| GB | 2056341 | * 3/1981 |

* cited by examiner

*Primary Examiner*—Kuang Y. Lin
(74) *Attorney, Agent, or Firm*—MacMillan, Sobanski & Todd, LLC

(57) ABSTRACT

An apparatus for producing a plurality of cast products includes a plurality of molds, and a casting apparatus which casts products in the molds. A multi-level pallet carries the molds containing the cast products on at least two vertical levels. A loading apparatus loads the molds onto the multi-level pallet. A conveyor moves the multi-level pallet through a cooling area which is sufficient to cool the cast products for removal from the molds. An unloading apparatus unloads the molds from the multi-level pallet. In a method of producing a plurality of cast products, the products are cast in a plurality of molds. The molds are loaded onto a multi-level pallet which carries the molds on at least two vertical levels. The multi-level pallet is conveyed through a cooling area which is sufficient to cool the cast products for removal from the molds. After cooling, the molds are unloaded from the multi-level pallet.

20 Claims, 5 Drawing Sheets

APPARATUS AND METHOD FOR PRODUCING CAST PRODUCTS

BACKGROUND OF THE INVENTION

This invention relates in general to the manufacture of cast products, and in particular to an apparatus and a method for producing cast products including an improved method of cooling the products after casting.

Cast products are typically manufactured by pouring or injecting molten material into molds, and then allowing the molten material to cool so that it solidifies. The solidified products are then removed from the molds. In a continuous manufacturing process, the molds containing the molten material are often transported on a conveyor until they are sufficiently cooled so that the products can be removed from the molds. In some processes, the molds are transported on a conveyor which is configured in a serpentine pattern.

The conventional use of a conveyor for cooling cast products typically requires a large amount of floor space in the manufacturing plant, even when the conveyor is configured in a serpentine pattern. The cooling on the conveyor also limits the speed at which cast products can be manufactured in the process. Thus, it would be desirable to provide an improved apparatus and method for producing cast products, including an improved method of cooling the products after casting.

SUMMARY OF THE INVENTION

The present invention provides an apparatus for producing a plurality of cast products. The apparatus includes a plurality of molds, and a casting apparatus which casts products in the molds. A multi-level pallet carries the molds containing the cast products on at least two vertical levels. A loading apparatus loads the molds onto the multi-level pallet. A conveyor moves the multi-level pallet through a cooling area which is sufficient to cool the cast products for removal from the molds. An unloading apparatus unloads the molds from the multi-level pallet.

The invention also provides a method of producing a plurality of cast products. In a first step, the products are cast in a plurality of molds. The molds are then loaded onto a multi-level pallet which carries the molds on at least two vertical levels. The multi-level pallet is conveyed through a cooling area which is sufficient to cool the cast products for removal from the molds. After cooling, the molds are unloaded from the multi-level pallet.

The use of multi-level pallets to carry the molds on a conveyor greatly increases the number of molds which can be cooled in a given floor space. This allows the manufacturer to speed up the casting process. Alternatively, the casting process can be conducted at the same speed, and the amount of floor space used for cooling can be reduced, thereby reducing manufacturing costs.

Various other advantages of this invention will become apparent to those skilled in the art from the following detailed description of the preferred embodiment, when read in light of the accompanying drawings.

DESCRIPTION OF THE PREFERRED EMBODIMENT

Figure 1:
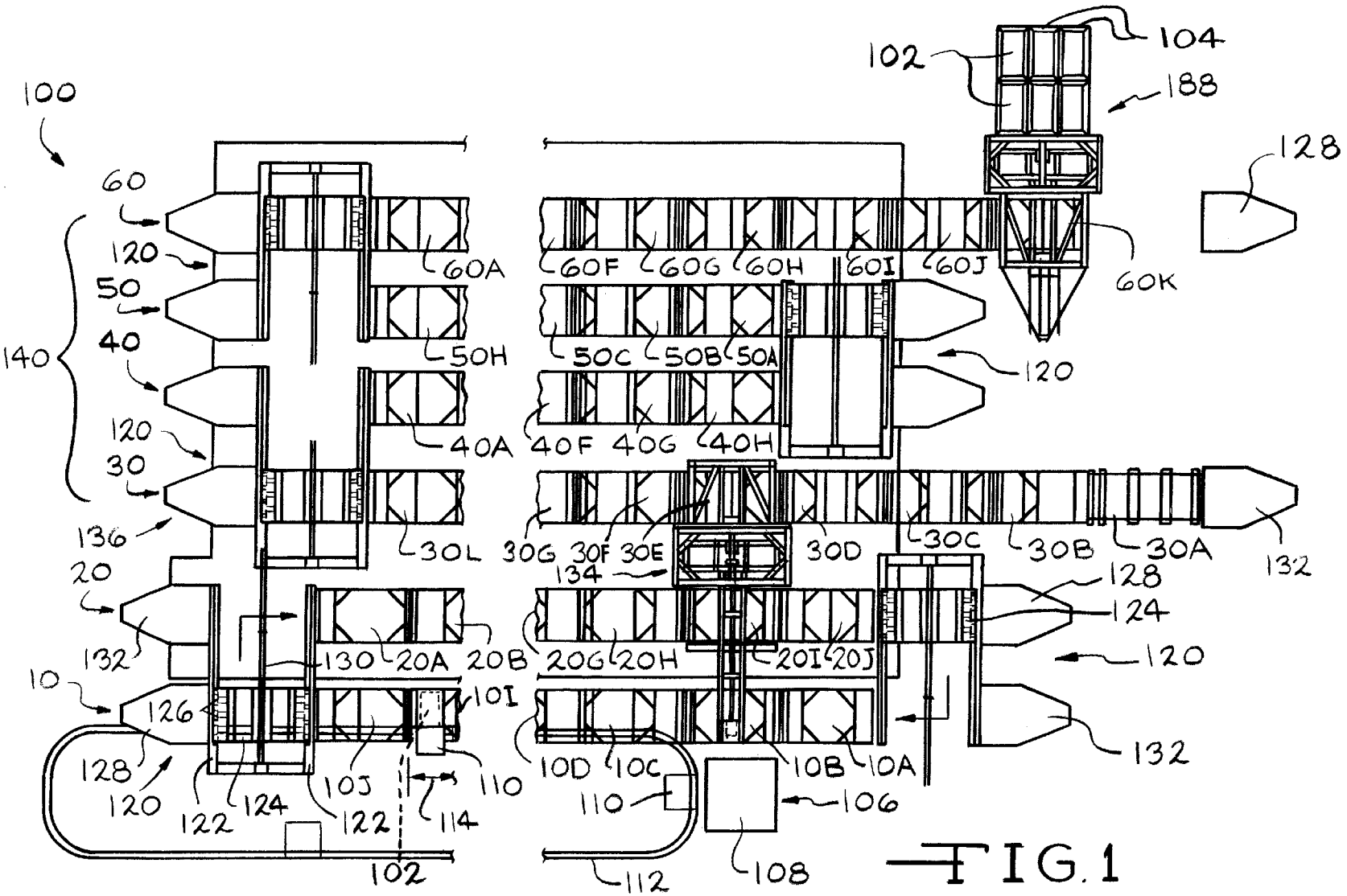
FIG. 1 is a top view, partially broken away, of an apparatus for producing cast products in accordance with the present invention.

Referring now to the drawings, FIG. 1 illustrates an apparatus, indicated generally at 100, for producing cast products in accordance with the present invention. Although the invention will be shown and described in conjunction with the particular apparatus 100 disclosed herein, it will be appreciated that the apparatus 100 can be other than as shown and described if desired.

The apparatus 100 includes a casting apparatus, indicated generally at 106, for casting products in molds 102. (One mold 102 is shown in phantom near the bottom of FIG. 1, and additional molds 102 are shown at the top right of the drawing). The casting apparatus 106 is conventional and therefore need not be described in any detail. The casting apparatus 106 can be any type of apparatus suitable for casting the products in the molds 102. A typical casting apparatus includes a source of molten material and an apparatus for transporting the molten material from the source to the molds 102. For example, the molten material can be poured into the molds 102 from heated containers, or it can be pumped through a conduit and injected into the molds.

In the illustrated embodiment, the casting apparatus 106 includes a source 108 of molten material (shown schematically), such as a furnace having a molten material reservoir. The molten material is transferred from the source 108 to a plurality of heated tiltable ladles 110 which are conveyed on a monorail 112 around a loop. When each of the ladles 110 reaches a pouring zone 114, the molten material is poured from the ladle 110 into a respective mold 102. The ladle 110 returns on the monorail 112 to the source 108 of molten material, where it is filled again with the molten material. Preferably, the casting apparatus 106 is computer controlled.

Figure 2:
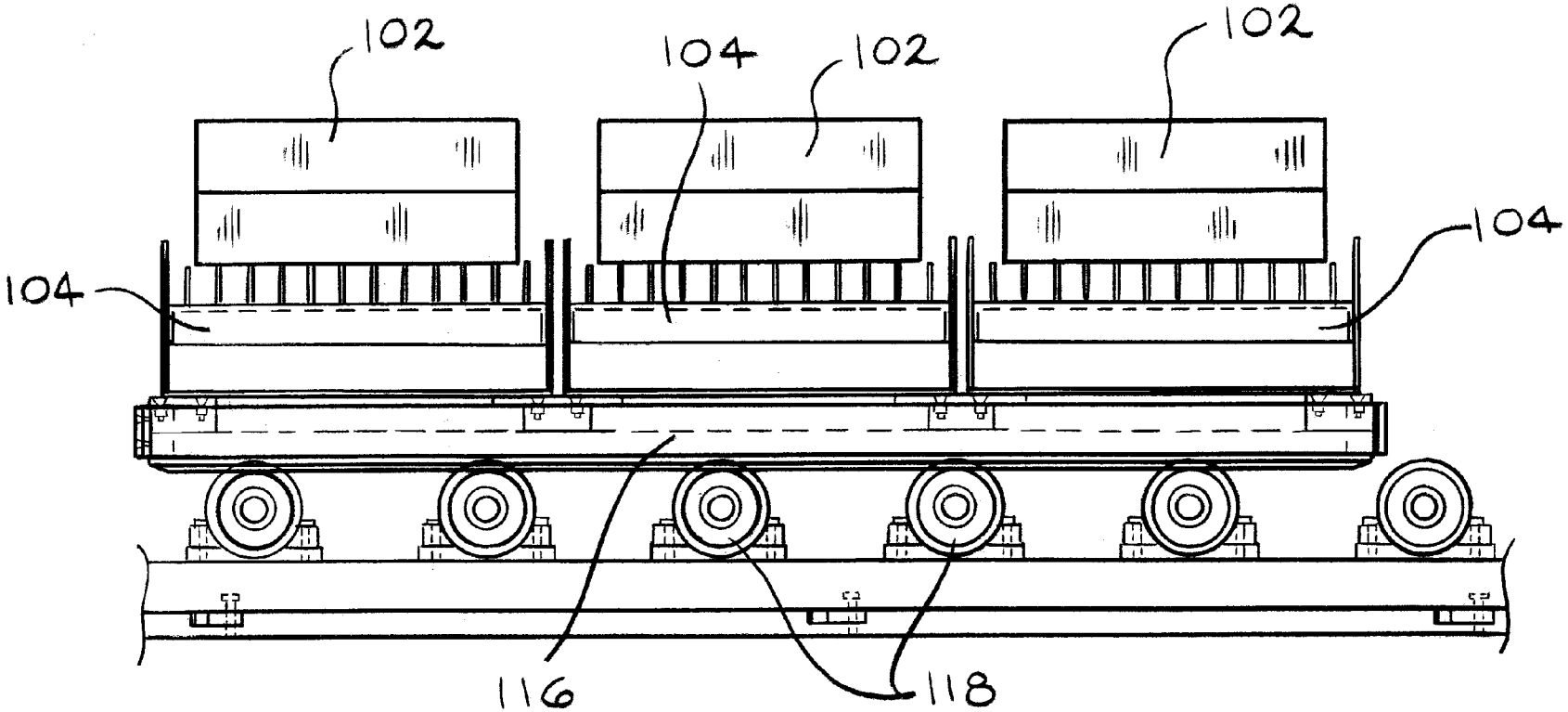
FIG. 2 is a side view of a pallet holding three molds on a conveyor of the apparatus shown in FIG. 1.

As shown in FIG. 2, the molds 102 are conventional and therefore need not be described in any detail. The molds 102 can be any type of molds suitable for casting the products, such as open molds or injection molds. Each of the molds 102 has one or more cavities (not shown) in which molten material is received for casting the products. In a specific embodiment, each mold 102 has two cavities for casting products. The illustrated apparatus also includes a plurality of trays 104. The trays 104 hold the molds 102 to keep them oriented in a stable position during the casting process. However, it will be appreciated that the molds 102 can be used without the trays 104.

The cast products can be any type of products which can be formed by a casting process. For example, the cast products can be vehicle parts, such as wheel end components or exhaust manifolds. The material used for casting the products can be any suitable casting material, including metals such as iron, aluminum or steel, metal alloys such as iron alloys or aluminum alloys, ceramics or plastics.

As shown in FIG. 1, the apparatus 100 also includes a first conveyor 10 to move the molds through the pouring zone 114. Any type of conveyor 10 suitable for moving the molds 102 can be used as the first conveyor 10. The illustrated first conveyor 10 is a pallet type of conveyor which uses a plurality of single level pallets 116 to move the molds 102. As shown in FIG. 2, the pallets 116 ride on rollers 118 which enable the pallets 116 to be moved along the first conveyor 10, one pallet 116 after another. The trays 104 holding the molds 102 are mounted on top of the pallets 116. In the embodiment shown, each pallet 116 holds three molds 102, although the number of molds 102 per pallet 116 can be other than illustrated if desired.

The illustrated first conveyor 10 is a conveyor line 10 having conveyor sections 10A through 10J in successive order (sections 10E through 10H not shown). The trays 104 and molds 102 are loaded on a pallet 116 at conveyor section 10A. The apparatus 100 includes a push device 132 having an extendable hydraulic cylinder (not shown). The cylinder extends to push an empty pallet (not shown) into conveyor section 10A for loading, thereby forcing the loaded pallet 116 to move into conveyor section 10B. This action is continuously repeated, and the pallet 116 carrying the trays 104 and molds 102 moves through conveyor sections 10C, 10D, etc., in sequence (from right to left in FIG. 1). When the pallet 116 reaches conveyor section 101, the molds 102 carried by the pallet 116 are located in the pouring zone 114. The molten material is poured from the ladles 110 into the molds 102 in the pouring zone 114.

After the pallet 116 moves through conveyor section 10J, the pallet 116 reaches a pallet transfer assembly, indicated generally at 120. The pallet transfer assembly 120 moves the pallet 116 from the end of the first conveyor 10 to the start of a second conveyor 20. The pallet transfer assembly 120 includes a pair of spaced apart rails 122 which extend transversely between the first and second conveyors 10, 20. A movable conveyor section 124 is mounted on the rails 122, and rides on the rails 122 on a plurality of rollers 126. The movable conveyor section 124 also has rollers (not shown) mounted on its upper surface. The rollers on the upper surface of the movable conveyor section 124 are aligned with the rollers 118 of the first conveyor 10 so that the pallet 116 can move from the first conveyor 10 onto the movable conveyor section 124. The pallet transfer assembly 120 includes a catch device 128 which stops the pallet 116. The pallet transfer assembly 120 also includes a transverse hydraulic cylinder 130 which is attached to the movable conveyor section 124 to move it along the rails 122. When the pallet 116 is located on the movable conveyor section 124, the transverse cylinder 130 moves the movable conveyor section 124 from the first conveyor 10 to the second conveyor 20. The pallet transfer assembly 120 further includes a push device 132 having an extendable hydraulic cylinder (not shown). The cylinder extends to push the pallet 116 from the movable conveyor section 124 into a starting conveyor section 20A of the second conveyor 20.

The illustrated second conveyor 20 is a conveyor line 20 having conveyor sections 20A through 20J in successive order (sections 20C through 20F not shown). As the push device 132 continuously pushes pallets 116 into the conveyor section 20A, the preceding pallets 116 are forced to move through conveyor sections 20B, 20C, etc., in sequence (from left to right in FIG. 1). When a pallet 116 reaches conveyor section 201, the pallet 116 is located in a loading station 134 of the apparatus 100. As described in detail below, the trays 104 and molds 102 are removed from the pallet 116 in the loading station 134. The empty pallet 116 then continues along the second conveyor 20 until it reaches another pallet transfer assembly 120 like the one described above. The pallet transfer assembly 120 moves the empty pallet 116 from the end of the second conveyor 20 to the start of the first conveyor 10 (conveyor section 10A) for another cycle.

Figure 3:
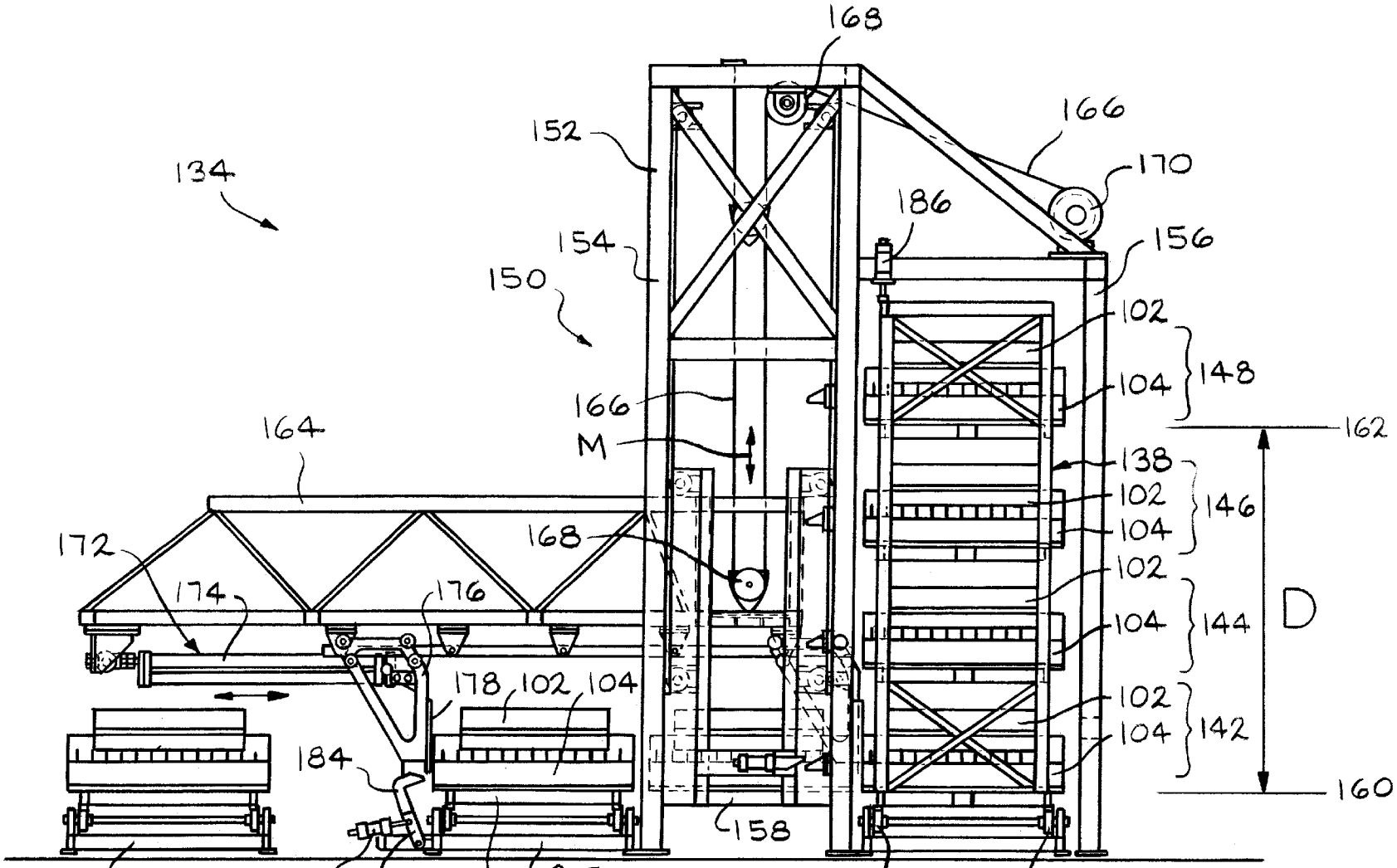
FIG. 3 is a side view of a loading station of the apparatus shown in FIG. 1.
Figure 4:
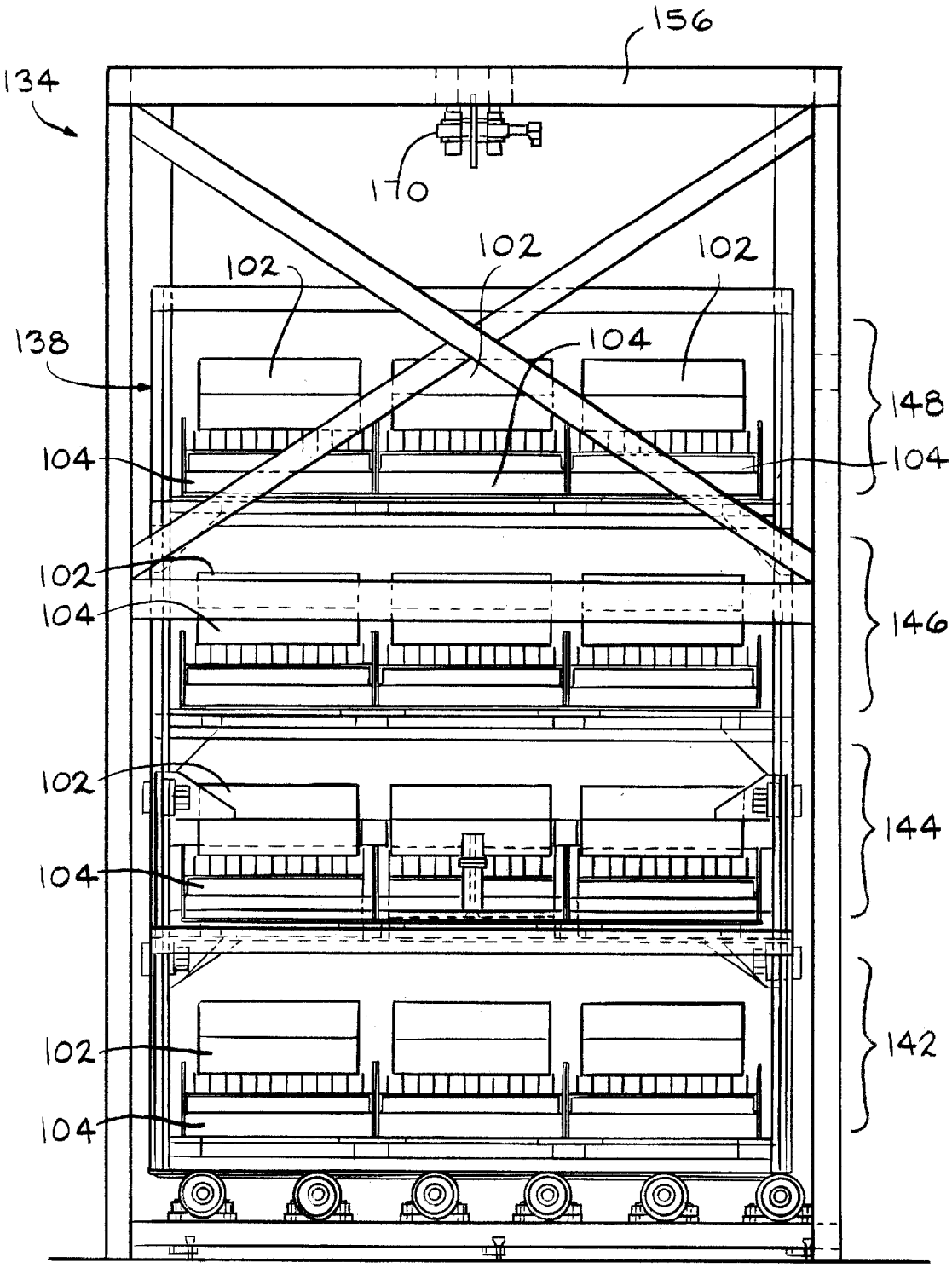
FIG. 4 is a front view of the loading station of FIG. 3, showing a multi-level pallet loaded with twelve molds.

The apparatus 100 of the invention includes an improved cooling apparatus, indicated generally at 136, for cooling the cast products. As best shown in FIGS. 3 and 4, the cooling apparatus 136 starts with the loading station 134, where a plurality of trays 104 and molds 102 are transferred from the single level pallet 116 to a multi-level pallet indicated generally at 138. As described in detail below, a plurality of the multi-level pallets 138 are moved along a cooling conveyor system 140 (shown in FIG. 1) for cooling the cast products. The multi-level pallet 138 has at least two vertical levels for carrying the trays 104 and molds 102, and preferably at least three vertical levels. In the illustrated embodiment, the multi-level pallet 138 is constructed as a rack having four vertical levels 142, 144, 146 and 148 or shelves for carrying the trays 104 and molds 102. The vertical levels 142, 144, 146 and 148 of the multi-level pallet 138 are separated by a distance sufficient to allow cooling of the cast products for removal from the molds 102. If the vertical levels 142, 144, 146 and 148 are too close to one another, heat from a mold 102 on a lower level 142 may travel upward and prevent sufficient cooling of a mold 102 on an adjacent upper level 144. Preferably, the multi-level pallet 138 is constructed to carry a plurality of trays 104 and molds 102 on each of the vertical levels 142, 144, 146 and 148. In the illustrated embodiment, the multi-level pallet 138 carries three trays 104 and molds 102 on each of the four vertical levels 142, 144, 146 and 148.

The loading station 134 includes a loading apparatus 150 which transfers the trays 104 and molds 102 from the single level pallet 116 to the multi-level pallet 138. Any type of apparatus suitable for transferring the trays 102 and molds 104 to the multi-level pallet 138 can be used. In the illustrated embodiment, the loading apparatus 150 includes an elevator-like frame 152 having a first frame portion 154 and a second frame portion 156. A loading elevator 158 is mounted inside the first frame portion 154 for upward and downward movement, as indicated by arrow M. The loading elevator 158 can travel a vertical distance D (from ground zero 160 to an upper elevation 162 of its travel) which is equal to the distance between the first level 142 and the fourth level 148 of the multi-level pallet 138. An arm 164 is carried by the loading elevator 158, and extends out of the frame 152 over the second conveyor 20. A cable 166 and pulley 168 apparatus is attached to the arm 164 inside the frame 152 for moving the loading elevator 158 and the arm 164 upward and downward. A hoist 170 mounted on the top of the second frame portion 156 retracts or extends the cable 166 to raise or lower the loading elevator 158 and the arm 164. The second frame portion 156 extends over conveyor section 30E of conveyor line 30 of the cooling conveyor system 140. The multi-level pallet 138 on the conveyor section 30E is positioned inside the second frame portion 156 for loading of the trays 104 and molds 102.

The loading apparatus 150 includes a motive power device 172 for moving the trays 104 and molds 102 from the single level pallet 116 to the multi-level pallet 138. In the illustrated embodiment, the motive power device 172 is a pushing device 172 which is mounted on the bottom of the arm 164. The illustrated pushing device 172 includes an extendable hydraulic cylinder 174 having a linkage 176 attached at the end, and a transversely extending push board 178 attached to the linkage 176. When the arm 164 is in the lowered position shown in FIG. 3, the push board 178 of the pushing device 172 is adjacent to the three trays 104 in the single level pallet 116. In operation, a clamp 180 mounted on the second conveyor 20 clamps onto the pallet 116 to hold it in place. Any suitable clamping device 180 can be used, such as a pneumatic clamp cylinder 182 attached to a hook 184 which clamps the pallet 116. Then the hydraulic cylinder 174 is extended to push the trays 104 and the molds 102 from the single level pallet 116 into the loading elevator 158.

A clamp 186 mounted on the second frame portion 156 clamps onto the top of the multi-level pallet 138 to hold it in place. Any suitable clamping device 186 can be used, such as a pneumatic clamp cylinder 186. If the trays 104 and molds 102 are to be loaded onto the first level 142 of the multi-level pallet 138, the hydraulic cylinder 174 is extended to push the trays 104 and molds 102 onto the first level 142. If the trays 104 and molds 102 are to be loaded onto the second 144 or higher level of the multi-level pallet 138, the hoist 170 is operated to move the loading elevator 158 and the arm 164 to the appropriate vertical position. Then the hydraulic cylinder 174 is extended to push the trays 104 and the molds 102 onto the selected level of the multi-level pallet 138. Instead of having a single pushing device 172 mounted for movement with the loading elevator 158, the loading apparatus 150 could include multiple stationary pushing devices, one for each level of the multi-level pallet 138. The multi-level pallet 138 having four levels 142, 144, 146 and 148 can hold the trays 104 and molds 102 carried on four of the single level pallets 116.

After the trays 104 and molds 102 are loaded on the multi-level pallet 138, the molten material in the molds 102 is allowed to cool so that it solidifies and forms solid cast products which can be removed from the molds 102. As shown in FIG. 1, the improved cooling apparatus 136 of the invention includes a cooling conveyor system, indicated generally at 140, for allowing the cooling of the material in the molds 102. The cooling conveyor system 140 can be any type of conveyor system suitable for transporting the multi-level pallets 138 to cool the material in the molds 102. In the illustrated embodiment, the cooling conveyor system 140 includes individual conveyor lines 30, 40, 50 and 60 which are operatively connected to one another in successive order. The illustrated conveyor lines 30, 40, 50 and 60 are arranged in a serpentine configuration, although other configurations can be used. The multi-level pallets 138 are moved on rollers 118 (shown in FIG. 3) along the conveyor lines 30, 40, 50 and 60, one pallet 138 after another.

Conveyor line 30 includes conveyor sections 30A through 30L in successive order (sections 30H through 30K not shown), extending from right to left in FIG. 1. The multi-level pallets 138 are placed on the conveyor line 30 at conveyor section 30A. A push device 132 has a hydraulic cylinder (not shown) which pushes the multi-level pallet 138 from conveyor section 30A to conveyor section 30B. As additional multi-level pallets 138 are placed on the conveyor line 30 and pushed by the push device 132, the multi-level pallet 138 moves through conveyor sections 30C and 30D. When it reaches conveyor section 30E, the multi-level pallet 138 is positioned in the loading station 134, where it is loaded with trays 104 and molds 102 as described above. After loading, the multi-level pallet 138 moves through conveyor sections 30F, 30G, etc., until it reaches the end of conveyor line 30. A pallet transfer assembly 120 is located at the end of conveyor line 30 to move the multi-level pallet 138 from the end of conveyor line 30 to the start of conveyor line 40.

Conveyor line 40 includes conveyor sections 40A through 40H in successive order (sections 40B through 40E not shown), extending from left to right in FIG. 1. The multi-level pallet 138 moves to the end of conveyor line 40, where it reaches another pallet transfer assembly 120. The pallet transfer assembly 120 moves the multi-level pallet 138 from the end of conveyor line 40 to the start of conveyor line 50.

Similarly, conveyor line 50 includes conveyor sections 50A through 50H in successive order (sections 50D through 50G not shown), extending from right to left in FIG. 1. The multi-level pallet 138 moves to the end of conveyor line 50, where it reaches another pallet transfer assembly 120. The pallet transfer assembly 120 moves the multi-level pallet 138 from the end of conveyor line 50 to the start of conveyor line 60.

Conveyor line 60 includes conveyor sections 60A through 60K in successive order (sections 60B through 60E not shown), extending from left to right in FIG. 1. The multi-level pallet 138 moves to the end of conveyor line 60, where it reaches an unloading station 188. As described in more detail below, the trays 104 and molds 102 are unloaded from the multi-level pallet 138 in the unloading station 188. After the multi-level pallet 138 is unloaded, a catch device 128 extends a hydraulic cylinder (not shown) to pull the multi-level pallet 138 from the unloading station 188. The empty multi-level pallet 138 is then returned to conveyor section 30A for another cycle through the cooling conveyor system 140.

Figure 5:
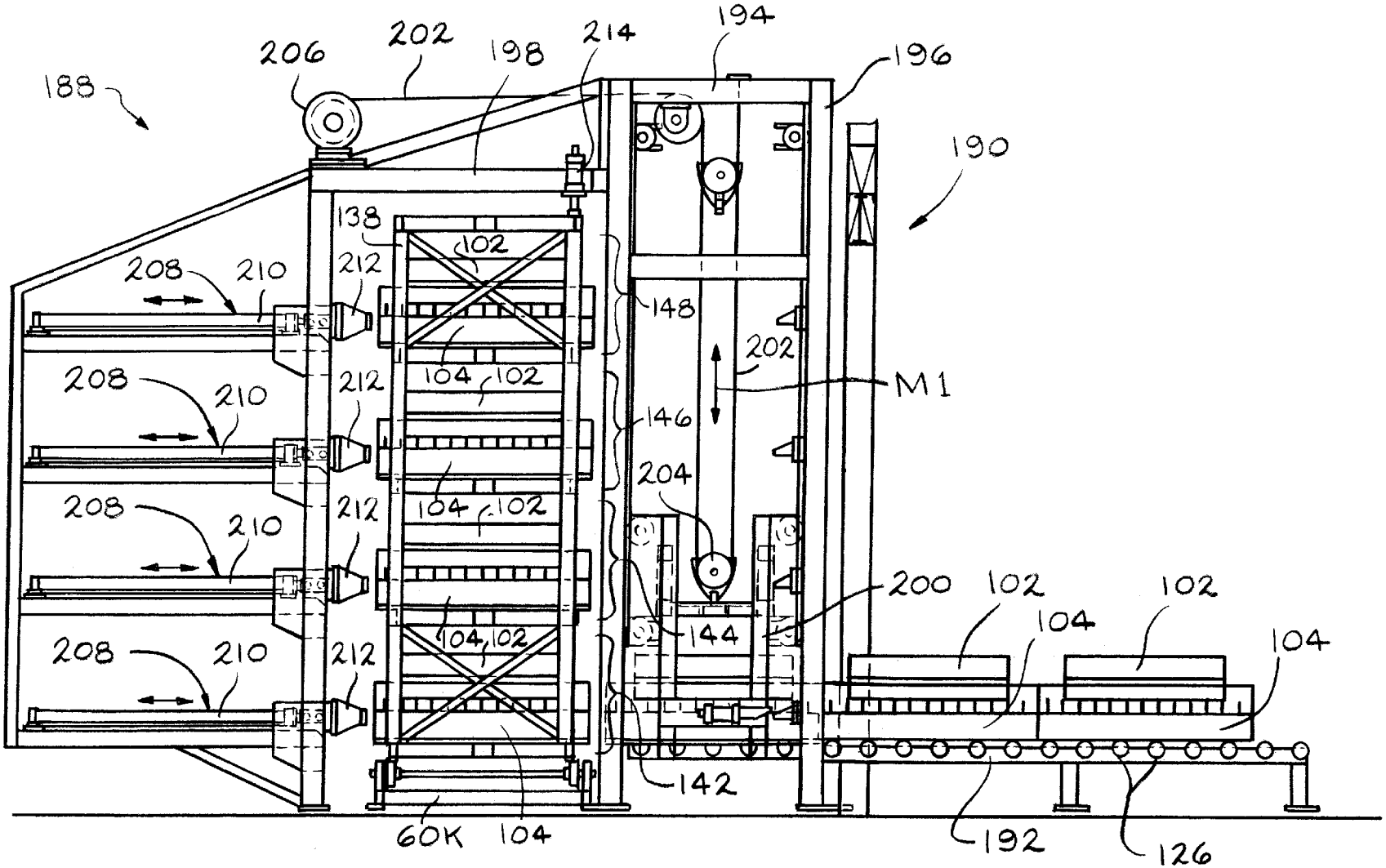
FIG. 5 is a side view of an unloading station of the apparatus shown in FIG. 1.

FIG. 5 illustrates the unloading station 188 where the trays 104 and molds 102 are removed from the multi-level pallets 138 after cooling. The unloading station 188 includes an unloading apparatus 190 which transfers the trays 104 and molds 102 from the multi-level pallet 138 to an unloading conveyor 192. Any type of apparatus suitable for transferring the trays 104 and molds 102 from the multi-level pallet 138 can be used. In the illustrated embodiment, the unloading apparatus 190 includes an elevator-like frame 194 having a first frame portion 196 and a second frame portion 198. An unloading elevator 200 is mounted inside the first frame portion 196 for upward and downward movement in the direction of arrow M1. A cable 202 and pulley 204 assembly is carried by the unloading elevator 200 for moving it upward and downward. A hoist 206 mounted on the top of the second frame portion 198 retracts or extends the cable 202 to raise or lower the unloading elevator 200. The multi-level pallet 138 on conveyor section 60K of the conveyor line 60 is positioned inside the second frame portion 198 for unloading.

The unloading apparatus 190 includes multiple motive power devices 208 for moving the trays 104 and molds 102 from the multi-level pallet 138 onto the unloading elevator 200. In the illustrated embodiment, the motive power devices 208 are pushing devices 208 which are mounted adjacent the multi-level pallet 138. Each of the illustrated pushing devices 208 includes an extendable hydraulic cylinder 210 having a transversely extending push bar 212 attached at an end thereof. In the illustrated embodiment, the unloading apparatus 190 includes one pushing device 208 for each level of the multi-level pallet 138. The pushing devices 208 are aligned with the trays 104 in the respective levels 142, 144, 146 and 148 of the multi-level pallet 138. It will be appreciated that the unloading apparatus 190 could include a single movable pushing device, like that shown in FIG. 3, instead of the multiple pushing devices 208.

In operation, a clamp 214 mounted on the second frame portion 198 clamps onto the top of the multi-level pallet 138 to hold it in place. Any suitable clamping device 214 can be used, such as a pneumatic clamp cylinder 214. The unloading elevator 200 is moved into alignment with one of the levels 142, 144, 146 or 148 of the multi-level pallet 138. Then the hydraulic cylinder 210 of the pushing device 208 aligned with the selected level is extended to push the trays 104 and the molds 102 onto the unloading elevator 200. If the trays 104 and molds 102 are to be unloaded from the first level 142 of the multi-level pallet 138, the hydraulic cylinder 210 is extended to push the trays 104 and molds 102 off the unloading elevator 200 and onto the unloading conveyor 192. If the trays 104 and molds 102 are to be unloaded from the second level 144 or a higher level of the multi-level pallet 138, the pushing device 208 aligned with that level first pushes the trays 104 and molds 102 onto the unloading elevator 200. Then the hoist 206 is operated to move the unloading elevator 200 down to the first level 142. Then the pushing device 208 aligned with the first level 142 is extended to push the trays 104 and the molds 102 onto unloading conveyor 192.

The unloading conveyor 192 has rollers 126 which enable the trays 104 and molds 102 to move away from the unloading apparatus 190. (The unloaded trays 104 and molds 102 are also shown in FIG. 1.) The trays 104 and molds 102 are then removed from the unloading conveyor 192, and the finished cast products (not shown) are removed from the molds 102. The empty trays 104 and molds 102 can be returned to conveyor section 10A for another cycle through the process.

In accordance with the provisions of the patents statutes, the principle and mode of operation of this invention have been described and illustrated in its preferred embodiment. However, it must be understood that the invention may be practiced otherwise than as specifically explained and illustrated without departing from the scope or spirit of the attached claims.

What is claimed is:

1. An apparatus for producing a plurality of cast products comprising:

a plurality of molds;

a casting apparatus which casts products in the molds;

a multi-level pallet which carries the molds containing the cast products on at least two vertical levels;

a loading apparatus which loads the molds onto the multi-level pallet;

a conveyor which moves the multi-level pallet through a cooling area which is sufficient to cool the cast products for removal from the molds; and an unloading apparatus which unloads the molds from the multi-level pallet.

2. The apparatus defined in claim 1 wherein the conveyor moves the multi-level pallet on a serpentine path through the cooling area.

3. The apparatus defined in claim 1 wherein the loading apparatus comprises a loading elevator.

4. The apparatus defined in claim 3 wherein the loading elevator travels a vertical distance which is equal to a distance between a bottom level and a top level of the multi-level pallet.

5. The apparatus defined in claim 1 wherein the unloading apparatus comprises an unloading elevator.

6. The apparatus defined in claim 5 wherein the unloading elevator includes a clamping device which holds the multi-level pallet and a motive power device which moves the molds from the multi-level pallet.

7. The apparatus defined in claim 6 wherein the unloading elevator includes a plurality of the motive power devices, with one of the motive power devices being aligned with each level of the multi-level pallet.

8. The apparatus defined in claim 1 wherein the apparatus comprises a plurality of the multi-level pallets, and wherein the conveyor moves the plurality of multi-level pallets simultaneously through the cooling area.

9. The apparatus defined in claim 1 further comprising a plurality of trays which hold the molds to keep them oriented in a stable position.

10. The apparatus defined in claim 1 wherein the multi-level pallet carries a plurality of the molds on each of the vertical levels.

11. The apparatus defined in claim 1 wherein the multi-level pallet carries the molds on at least three vertical levels.

12. The apparatus defined in claim 1 wherein the vertical levels of the multi-level pallet are separated sufficiently to allow cooling of the cast products for removal from the molds.

13. The apparatus defined in claim 1 further comprising a single level pallet which carries the molds on a single vertical level, and a conveyor which moves the single level pallet from the casting apparatus to the loading apparatus.

14. The apparatus defined in claim 13 wherein the loading elevator includes a clamping device which holds the single level pallet and a motive power device which moves the mold from the single level pallet to the multi-level pallet.

15. A method of producing a plurality of cast products comprising:

casting products in a plurality of molds;

loading the molds onto a multi-level pallet which carries the molds on at least two vertical levels;

conveying the multi-level pallet through a cooling area which is sufficient to cool the cast products for removal from the molds; and unloading the molds from the multi-level pallet.

16. The method defined in claim 15 wherein the loading step comprises loading the molds with a loading elevator.

17. The method defined in claim 15 wherein the unloading step comprises unloading the molds with an unloading elevator.

18. The method defined in claim 17 wherein the unloading step includes holding the multi-level pallet in place when moving the molds from the multi-level pallet.

19. The method defined in claim 15 wherein the conveying step comprises conveying a plurality of the multi-level pallets through the cooling area simultaneously.

20. The method defined in claim 15 wherein the molds are loaded onto a multi-level pallet which carries the molds on at least three vertical levels.

* * * * *